US005421264A

United States Patent [19]

Petrick

[11] Patent Number: 5,421,264

[45] Date of Patent: Jun. 6, 1995

[54] FIREARM CARTRIDGE WITH PRE-PRESSURIZING CHARGE

[75] Inventor: John T. Petrick, Largo, Fla.

[73] Assignee: Colt's Manufacturing Company Inc., West Hartford, Conn.

[21] Appl. No.: 161,308

[22] Filed: Dec. 2, 1993

Related U.S. Application Data

[62] Division of Ser. No. 944,676, Sep. 15, 1992, abandoned.

[51] Int. Cl.[6] ..... F42B 5/16

[52] U.S. Cl. ..... 102/443; 102/472; 102/201

[58] Field of Search ..... 42/84; 86/10, 23, 25; 89/1.814, 28.05, 135; 102/200, 201, 202, 202.5, 430, 439, 443, 469, 470, 472

[56] References Cited

U.S. PATENT DOCUMENTS

| | | | |
|---|---|---|---|
| H1,214 | 8/1993 | Liva et al. | 102/201 |
| 34,615 | 3/1862 | Shannon | 102/443 |
| 49,773 | 9/1865 | Lugo | 102/443 |
| 162,901 | 5/1875 | Collett | 102/443 |
| 307,070 | 10/1884 | Russell | 42/84 |
| 392,922 | 11/1888 | Johnson et al. | 102/443 |
| 624,146 | 5/1899 | Young | 102/430 |
| 751,519 | 2/1904 | Kilzer | 102/443 |
| 1,920,075 | 7/1933 | Haenichen | 102/443 |
| 2,640,417 | 6/1953 | Bjork et al. | 102/202 |
| 3,177,651 | 4/1965 | Lawrence | 102/201 |
| 3,362,329 | 1/1968 | Epstein | 102/201 |
| 3,408,937 | 11/1968 | Lewis et al. | 102/201 |
| 3,413,888 | 12/1968 | Kaley | 89/28.05 |
| 3,442,213 | 5/1969 | Suzuki et al. | 102/431 |
| 3,563,177 | 2/1971 | Ritchey | 102/431 |
| 3,631,623 | 1/1972 | Platt | 42/84 |
| 3,685,392 | 8/1972 | Platt | 89/28.05 |
| 3,726,222 | 4/1973 | White et al. | 102/431 |
| 3,763,291 | 10/1973 | Loedding | 264/3.1 |
| 3,916,793 | 11/1975 | Galluzzi | 102/376 |
| 3,954,062 | 5/1976 | Dunlop et al. | 102/283 |
| 3,994,235 | 11/1976 | Politzer et al. | 102/431 |
| 4,619,202 | 10/1986 | Romer et al. | 102/443 |
| 4,625,648 | 12/1986 | Klein et al. | 102/286 |
| 4,793,085 | 12/1988 | Surawski et al. | 42/84 |
| 4,823,699 | 4/1989 | Farinacci | 102/443 |
| 4,892,037 | 1/1990 | Betts | 102/201 |
| 4,907,487 | 3/1990 | Tidman et al. | 89/28.05 |
| 5,212,339 | 5/1993 | Piltch | 102/202 |
| 5,227,577 | 7/1993 | Eich et al. | 89/28.05 |
| 5,272,828 | 12/1993 | Petrick et al. | 42/84 |

FOREIGN PATENT DOCUMENTS

| | | | |
|---|---|---|---|
| 3810048 | 10/1989 | Germany | 42/84 |
| 16874 | 12/1886 | United Kingdom | 102/443 |
| 9870 | of 1907 | United Kingdom | 102/443 |
| 2241563 | 9/1991 | United Kingdom | 89/28.05 |

OTHER PUBLICATIONS

York et al., "Internal Ballistics Measurements Using Gamma Beams", University of Michigan, pp. 1–11, Winter Meeting of the American Nuclear Society, Nov., 1963.

York et al., "Breech Pressure Breakthrough", The Gun Digest, 22nd Edition, 1968, pp. 17–22.

Bell et al., "Accurate Velocity & Pressure For the Price of An Average Hunting Rifle", Gunsport, Mar. 1968, pp. 41–43.

Lewis, "Pressure Friend and Foe?", Game News, Jun., 1969, pp. 58–64.

*Primary Examiner*—Stephen C. Bentley

*Attorney, Agent, or Firm*—Perman & Green

[57] ABSTRACT

A firearm cartridge with a pre-pressurizing charge and a main propellant charge. The pre-pressurizing charge is located adjacent the rear end of the projectile. The pre-pressurizing charge can burn and exert pressure on the main propellant charge without igniting the main propellant charge.

3 Claims, 5 Drawing Sheets

FIG. 10a
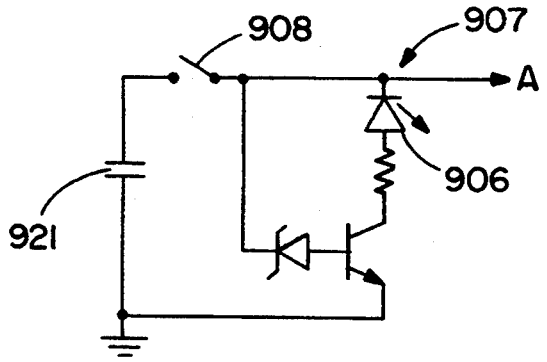
FIG. 10b
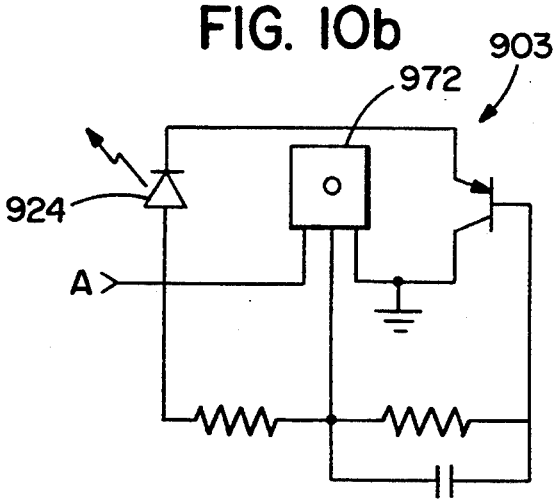
FIG. 10c
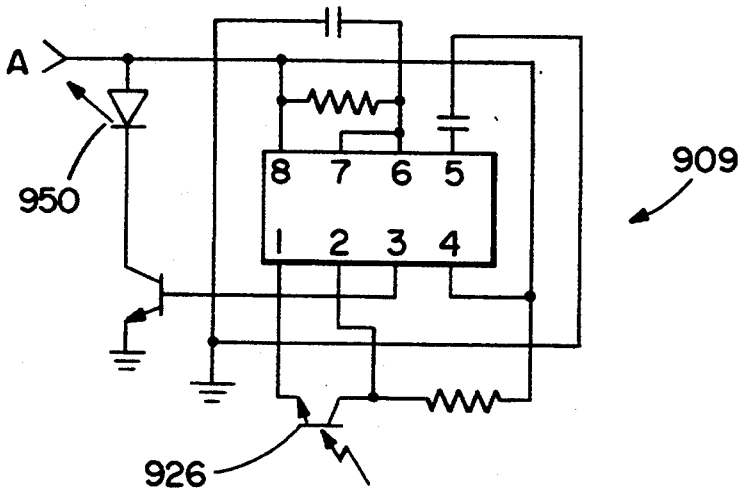
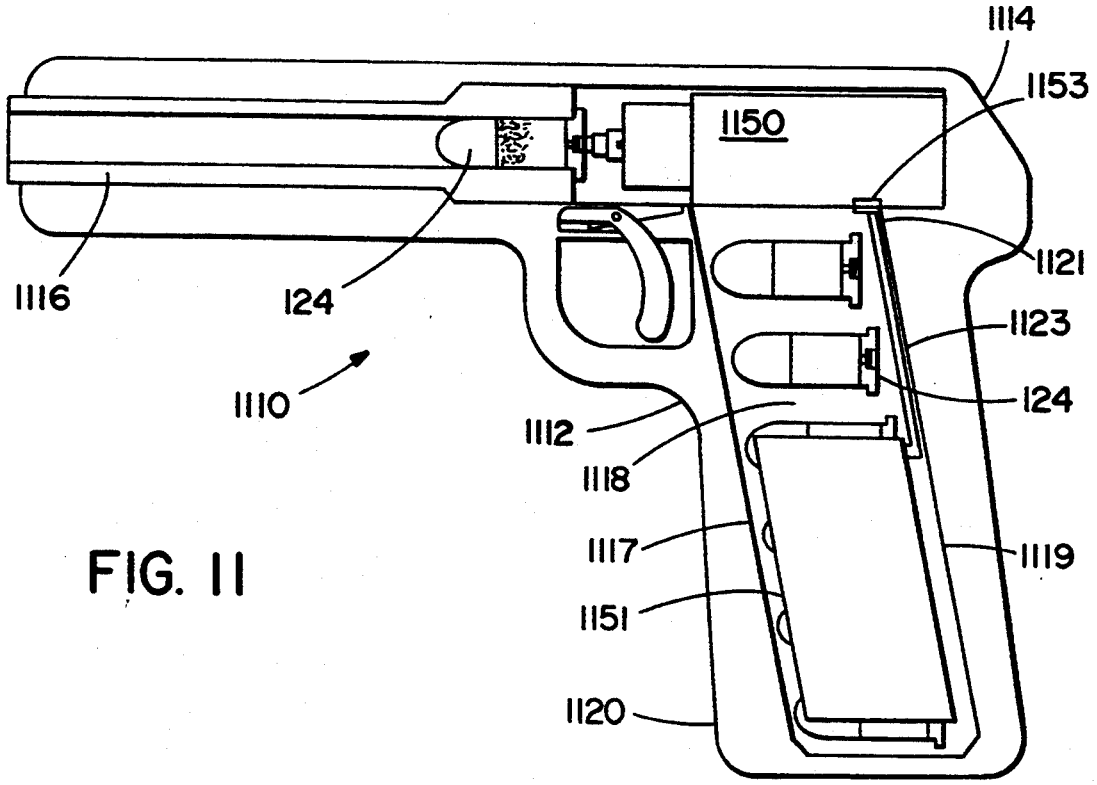
FIG. 11

FIREARM CARTRIDGE WITH PRE-PRESSURIZING CHARGE

This is a copending application Ser. No. 07/944,676, filed on Sep. 15, 1992, now abandoned.

BACKGROUND OF THE INVENTION

1. Field of the Invention

This invention relates to firearms and, more particularly, to systems in which a propellant is ignited or initiated by energy.

2. Prior Art

In most firearms, the principal propellant charge is ignited by an ignition composition, such as a primer. The primer is usually mechanically initiated, such as by percussion by a firing pin or striker. This primer percussion technique has a number of undesirable features. In particular, firearms that use primer percussion require a complicated system of moving parts to produce the mechanical impulse necessary from a firing pin to cause ignition of the primer. This movement produces both a mechanical impact, which can generate movement of the weapon, and distinctive sounds. In addition, the primer and main propellant generate corrosive combustion products which can require frequent weapon maintenance. However, percussion primer systems are nonetheless widely used largely because they are relatively inexpensive and reliable.

To avoid drawbacks associated with percussion primer systems, others have proposed firearms and cartridges in which ignition of the propellant is electrically controlled (e.g., U.S. Pat. Nos. 3,362,329, 3,413,888, 3,563,177, 3,726,222 and 4,619,202) or laser initiated. U.S. Pat. Nos. 3,631,623 and 3,685,392 disclose firearms in which laser energy passes through a window at the bottom or side of a cartridge base and ignites a primary explosive. U.S. Pat. No. 3,408,937 discloses a pyrotechnic detonator, ignited by laser energy injected into it by a light-conducting pipe, in which the laser beam may be interdicted by a shutter.

It is an objective of the present invention to overcome problems in the prior art and provide a new and improved system for initiating a propellant.

SUMMARY OF INVENTION

The foregoing problems are overcome and other advantages are provided by a new and improved system for propelling a projectile from a firearm.

In accordance with one embodiment of the present invention, a system for propelling a projectile from a firearm is provided comprising a barrel, a propellant charge, a source of energy, and means for transmitting energy. The barrel has a chamber for receiving the projectile. The propellant charge comprises a main propellant and an initiating propellant. The charge has a first end with the initiating propellant thereat. The charge is located adjacent the projectile with the first end thereagainst. The source of energy is located remote from the chamber and is adapted to generate waveform energy. The means for transmitting energy can transmit the energy from the source of energy to the initiating propellant in the chamber whereby ignition of the main propellant can be initiated proximate the projectile.

In accordance with another embodiment of the present invention, a system for propelling a projectile from a firearm is provided, the firearm having a frame, a barrel connected to the frame, the barrel having a cartridge chamber, a laser connected to the frame, and means for directing a laser beam from the laser into the chamber to discharge the firearm. The improvement comprises the cartridge having a laser beam ignitable initiator for igniting a main propellant, the initiator being located inside the cartridge spaced from a rear end of a casing of the cartridge.

In accordance with another embodiment of the present invention, a system for propelling a projectile from a firearm is provided. The firearm has a frame, a barrel connected to the frame, the barrel having a cartridge chamber, a source of waveform energy connected to the frame, and means for directing energy from the source of energy into the chamber to discharge the firearm. The improvement comprises the cartridge having means for transmitting the energy through a portion of a main propellant of the cartridge, without igniting the main propellant, to a primer of the cartridge where initiation of ignition of the main propellant can be commenced.

In accordance with one method of the present invention, a method of firing a projectile from a barrel is provided comprising steps of locating a primer adjacent a rear end of the projectile; and directing a beam of energy at the primer to ignite the primer such that initiation of combustion of a main propellant located behind the projectile can occur adjacent the rear end of the projectile.

In accordance with another embodiment of the present invention, a firearm cartridge is provided comprising a casing, a main propellant located inside the casing, a projectile connected to the casing, and means for transmitting laser energy. The means for transmitting laser energy can transmit the laser energy, at least partially, through the main propellant to a location spaced from the casing whereby ignition of the main propellant can be initiated at the location spaced from the spacing.

In accordance with another method of the present invention, a method of manufacturing a firearm cartridge is provided comprising steps of providing a casing having means for transmitting a beam of energy therethrough; inserting a main propellant into the casing; inserting a primer into the casing; and connecting a projectile to the casing, the primer being located in close proximity to a rear end of the projectile such that initiation of the main propellant can occur proximate the rear end of the projectile.

In accordance with another embodiment of the present invention, a firearm cartridge is provided comprising a casing, a projectile connected to the casing, a pre-pressurized charge located inside the casing, a main propellant charge located inside the casing, and a barrier. The barrier is located between the pre-pressurizing charge and the main propellant charge and is adapted to substantially prevent the pre-pressurizing charge from igniting the main propellant charge, but allow pressure from the burning of the pre-pressurizing charge to be exerted on the main propellant charge.

In accordance with another embodiment of the present invention, a firearm cartridge is provided comprising a casing, a projectile connected to the casing, a unitary propellant charge located in the casing, and an initiation charge located inside and surrounded by the unitary propellant charge.

In accordance with another method of the present invention, a method of manufacturing a firearm cartridge is provided comprising steps of providing a casing with means to allow a beam of energy to pass therethrough; forming a unitary propellant charge around an initiation charge, the unitary propellant charge having control surface regions therein and connected to the initiation charge, the control surface regions being adapted to relatively quickly spread combustion of the unitary propellant charge along a predetermined pattern; and connecting a projectile to the casing with the two charges located in the casing.

BRIEF DESCRIPTION OF THE DRAWINGS

These and other features and advantages will appear from the following detailed description of preferred embodiments of the invention, taken together with the attached drawings in which:

FIGS. 10*a* through 10*c* are schematics of electronic circuits in the pistol of FIG. 9.

FIG. 11 is a schematic view of a firearm having a cartridge magazine comprising features of the present invention.

DETAILED DESCRIPTION OF PREFERRED EMBODIMENTS

Figure 1:
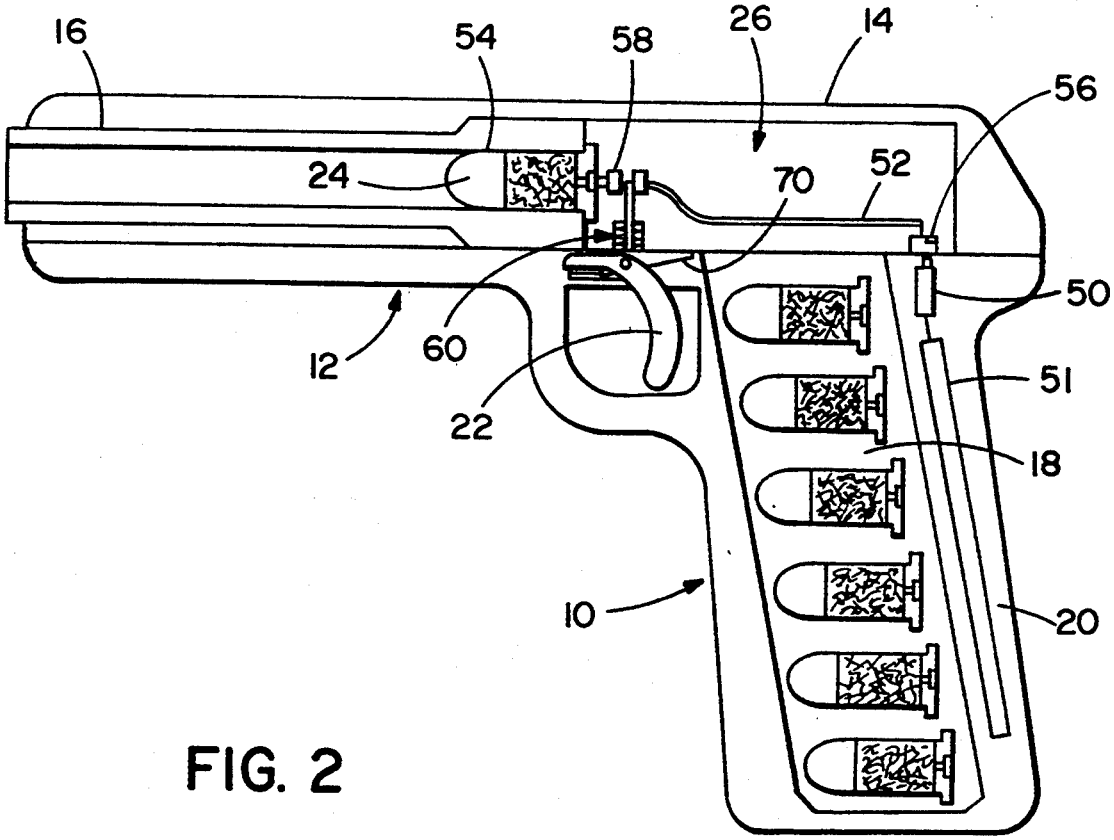
FIG. 1 is a schematic side view, partially cut-away, of a pistol embodying the invention.
Figure 2:
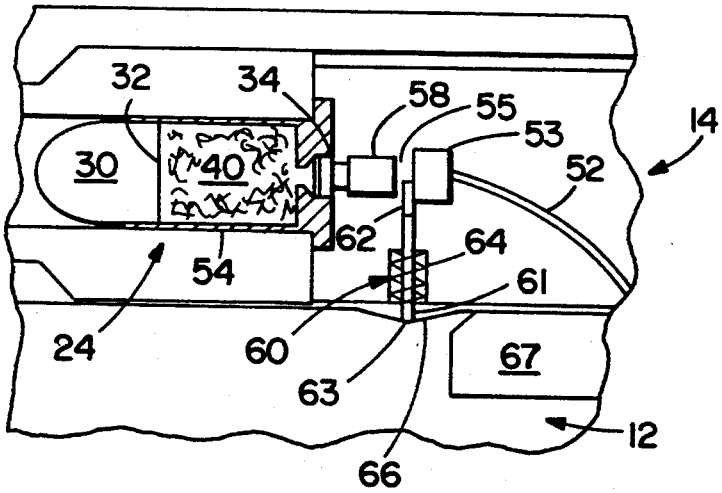
FIG. 2 is an enlarged view of a portion of the pistol of FIG. 1.

Referring now to the drawings, FIGS. 1 and 2 illustrate a firearm in the form of a pistol, generally designated 10, having a frame 12, a slide 14, a barrel 16, a cartridge magazine 18 in the handle 20 of the frame, and a trigger 22. Although the present invention will be described with reference to the embodiments shown in the drawings, it should be understood that the present invention is capable of being embodied into various different types of embodiments. In addition, any suitable size, shape or type of elements or materials can be used as further understood from the description below. It should also be understood that, as used herein, the term "firearm" is intended to include handguns, launchers, shotguns, rifles, machine guns, cannon or artillery, or any type of system or gun that uses combustion or ignition of a material to propel an article or articles from a barrel. As used herein, the term "primer" is intended to mean any suitable type of initiating charge adapted to initiate combustion of a propellant. As used herein, the terms "propellant" and "main propellant" are intended to mean any suitable type of combustible material adapted to generate gases to propel a projectile from a firearm. The propellant can include a single type of material or multiple types of materials and, with multiple types of materials, the materials can be arranged in any suitable type of uniform, nonuniform, or patterned configurations. The materials can also be provided as powder, unary, solidified liquid, etc. In addition, the term "slide" as used herein is intended to include a bolt, a breech block, or a breech face of any member or members adapted to close over the breech of a firearm. As used herein, the term "waveform energy" and "energy" is intended to mean any suitable type of electromagnetic energy or energy transmitted by means of a wave including infra-red, microwave, laser, flashlamp light, etc. As used herein, the term "unary" is intended to mean consisting of a single element, item or component.

Pistol 10 differs from conventional semi-automatic pistols in two principal respects; the cartridge 24 used therein, and the firing mechanism 26. As will become evident, the firing mechanism 26 does not include the usual mechanical hammer and firing pin and, the cartridge 24 does not require impact by a firing pin to be actuated.

Figure 3A:
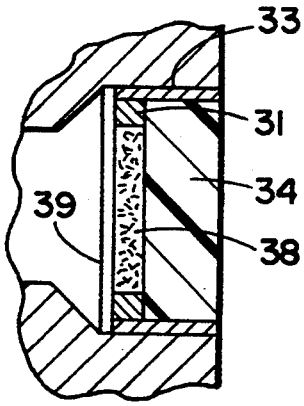
FIGS. 3 and 3*a* illustrate a cartridge used with the pistol if FIG. 1.
Figure 3:
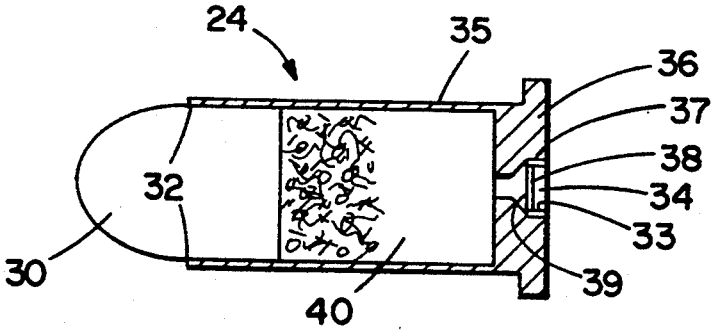

As shown most clearly in FIGS. 3 and 3*a*, cartridge 24 includes a standard projectile 30 mounted in the open end 32 of the cartridge case or casing 35. However, any suitable type of projectile could be provided. In the embodiment shown, the casing 35 has an optically transparent plug or window 34 (e.g., a transparent acrylic or a transparent cast epoxy such as that sold under the name DEVCON 5 MINUTE EPOXY). The window 34 is centered in the cartridge base 36. Cartridge case 35 is a standard .45 caliber brass case from which the conventional percussion primer has been removed. As shown, a stepped cylindrical cavity 37 extends coaxially through cartridge base 36. A brass primer ring 33, into which the transparent acrylic window 34 has been pressed and then polished, is press-fitted into the larger diameter, outer end of cavity 37. To hold window 34 in position during polishing, a second brass ring 31 is press-fitted into the inner end of ring 33, abutting the inner end of window 34. The inner end of ring 33 is closed by a paper or aluminum tape cover 39; and the primer or ignition composition 38 fills the cylindrical cavity within ring 33 between window 34 and cover 39. A standard load of main propellant 40, such as conventional smokeless powder, fills the cavity in cartridge case between the base of the casing 35 and the rear end or base end of projectile 30. It should be understood that casing 35 could include alternate embodiments such as a window in its side wall rather than its base or the case being made of an energy transparent polymer material.

The primer 38 is preferably a standard ignitor mixture to which a small percentage of zirconium or graphite may be added, or a Zr-$KC10_4$—C— Dupont VITON mixture (commonly referred to as the NASA Standard Initiator Mix) (VITON is a trademark of E. I. du Pont de Nemours & Co. for a series of fluoroelastomers), or a commercially available composition such as lead or barium styphnate, B-Zr-$KCL04_4$, or $TiKCL0_4$. However, any suitable type of primer or composition can be used. In a preferred embodiment, the primer is provided in the form of a disc or pellet that is inserted into the casing 35. In one form of the present invention, the primer is adapted to be ignited by a laser energy density of about 3–5 joules/$cm^2$. In an alternate embodiment, if the firearm 10 has a laser with a sufficiently high output, such as one that will deliver 10–15 J/$cm^2$ to the primer or other ignition composition, a main propellant 40 can be used that can be initiated directly by the available energy from the laser and a separate primer need not be provided. One type of main propellant that could be used without use of a primer is known as a U.S. Navy propellant N-12 or a colloidal propellant.

The firing system 26 generally comprises a laser 50, a battery 51, and optical fibers 52. The laser 50 is a battery-powered laser such as a C86104E or C86104F diode laser made by EG&G Canada Ltd. or a FIREFLY brand solid state laser made by Optical Kinetics of Largo, Florida. However, any suitable type of laser could be used. The battery 51 is preferably a 6 volt Nickel Cadmium or alkaline battery such as a POLAPULSE battery made by Polaroid. However, any suitable type of battery can be used. In the embodiment shown, the battery is mounted in the grip 20. The laser 50 is also mounted in the grip 20. However, it should be understood that the laser 50 and battery 51 could be located in any suitable location. Optical fibers 52 extend through the slide from a coupler 56 adjacent the laser 50 to a coupler 53 proximate cartridge chamber 54 in the barrel 16. The coupler 56, such as a quarter-pitch graded index ("GRIN") lens sold by Nippon Sheet Glass, is provided at the laser-end of the fibers 52 to collect laser energy from laser 50 and launch it into the fibers 52. A focusing lens 58 (typically also a GRIN lens but of different pitch and designed to collimate the laser) is mounted at the chamber-end of the fibers 52 across from coupler 53, coaxially aligned with the barrel 16 and cartridge 24, to direct the laser energy from the fibers 52 through window 34 into cartridge 24. In a preferred embodiment, the laser system produces a power density of about $2\times10^4$ J/$cm^2$ and delivers about 10 J/$cm^2$ to the primer 38.

In the embodiment shown, located between lens 58 and the coupler 53 at the end of the fibers 52 is a safety shutter or blocker assembly 60. As shown, blocker assembly 60 generally includes a shutter 62 mounted on, and vertically movable relative to, slide 14. The shutter 62 is movable between a firing position (shown in FIG. 2) in which the top portion of the shutter 62 is located in a first predetermined position in the path of the laser energy in the gap 55 between coupler 53 and lens 58, and a safety position shown in FIG. 1 in which the top portion of the shutter 62 is located in a second predetermined position in the gap 55 in the light path and blocks the passage of laser light through the gap 55. A spring 64 is provided to bias the shutter 62 downward towards the firing position. However, any suitable means could be provided to bias the shutter 62 in any suitable direction or position. In the embodiment shown, the blocker assembly 60 also has a pin or moving member 61 that is connected to the shutter 62 and is adapted to project below a portion of the slide 14. The moving member 61 is slidably connected to the slide 14 to longitudinally slide in and out of its holding hole in the slide 14. However, any suitable type of moving member could be provided and any suitable type of motion of the moving member 61 relative to slide 14 could also be provided. In an alternate embodiment, the moving member could also be fixedly connected to the frame 12 rather than the slide 14. In the embodiment shown, the bottom end of the moving member 61 is extendable out of the bottom of the slide 14 and is adapted to contact and ride upon a control surface 66 on the top of the frame 12. The control surface 66 is generally flat and uniform with the exception of depression 63. Depression 63 in control surface 66 permits spring 64 to move the moving member 61 to an extended position from the slide 14. Because the moving member 61 is fixedly connected to the shutter 62, the shutter plate 62 can thus be moved into its firing position when the pistol 10 is in a battery position; i.e.: when the slide 14 is all the way forward and against the rear end of the barrel 16. When the slide 14 of the pistol is not in its battery position (i.e., the breech is not closed because slide 14 is not fully forward), control surface 66 forces the moving member 61 forward or upward; out of the depression 63. This moves the shutter 62 into its safety position in which the upper portion of the shutter 62 blocks the laser light path. Additionally, a manual safety 67 is mounted on the side of frame 12 in position to be moved between a "safe" position in which it forces shutter 62 upward to block the laser light path when slide 14 is nonetheless is in its battery position, and a "firing" position in which, if the slide 14 is in its battery position, firing is permitted. Of course, the manual safety 67 need not be provided or, could be mounted to the slide 14 rather than the frame 12.

In a preferred embodiment, the upper portion of shutter is arranged to extend into the gap 55 and comprises a thin, flat circular plate having a small hole therethrough. The hole is only very slightly larger than the minimum size required for the laser beam from fibers 52 to reach the lens 58. Thus, only very slight movement of the shutter 62 is required to block the laser beam emanating from coupling at the end of fibers 52 from reaching the lens 58. The blocker assembly 60 thus provides a first safety system to prevent the firearm 10 from firing which can be actuated either manually, by use of manual safety 67, or automatically, due to relative motion or position of the slide 14 relative to the frame 12.

The firearm 10, in the embodiment shown, also comprises a second safety mechanism. As can be seen in FIG. 1, with the laser 50 located in the frame 12 and the coupler 56 at the laser-end of the fibers 52 being located in the slide, relative motion between the slide 14 and frame 12 will cause the alignment and misalignment of the coupler 56 with the output from the laser 50. When the slide 14 is in its battery position, as shown in FIG. 1, the output of the laser 50 is aligned with and directed at the coupler 56 and laser-end of the fibers 52. Thus, a laser beam can be directed from the laser 50 into the fibers 52. However, if the slide 14 is not in its battery position, the coupler 56 and laser-end of fibers 52 will not be aligned with the output from the laser 50. Therefore, in a misaligned configuration, a laser beam from the laser 50 will not be able to properly enter the fibers 52 at coupler 56 and, cannot travel through fibers 52 to initiate a primer or propellant. However, any suitable type of misalignment safety system could be provided.

In the embodiment shown, the trigger 22 is movably mounted to the frame 12 and is connected to a switch 70. The switch 70 is operably connected to the laser 50 and controls activation of the laser 50. In a preferred embodiment, the switch 70 is a Hall effect switch such a Honeywell Part No. 8553E1. However, any suitable type of means to activate the laser 50 upon pulling the trigger 22 could be provided. In the embodiment shown, as a user moves the trigger 22 in a rearward direction, a magnet inside the switch 70 is moved that signals the laser 50 to fire. However, any suitable type of switch 70 could be provided. If the coupler 56 is aligned with the output from the laser 50 and, the shutter 62 does not block a path between the coupler 53 and lens 58, a laser beam will be transmitted from the laser 50 to a cartridge located in the barrel cartridge chamber and the firearm will fire.

Figure 4:
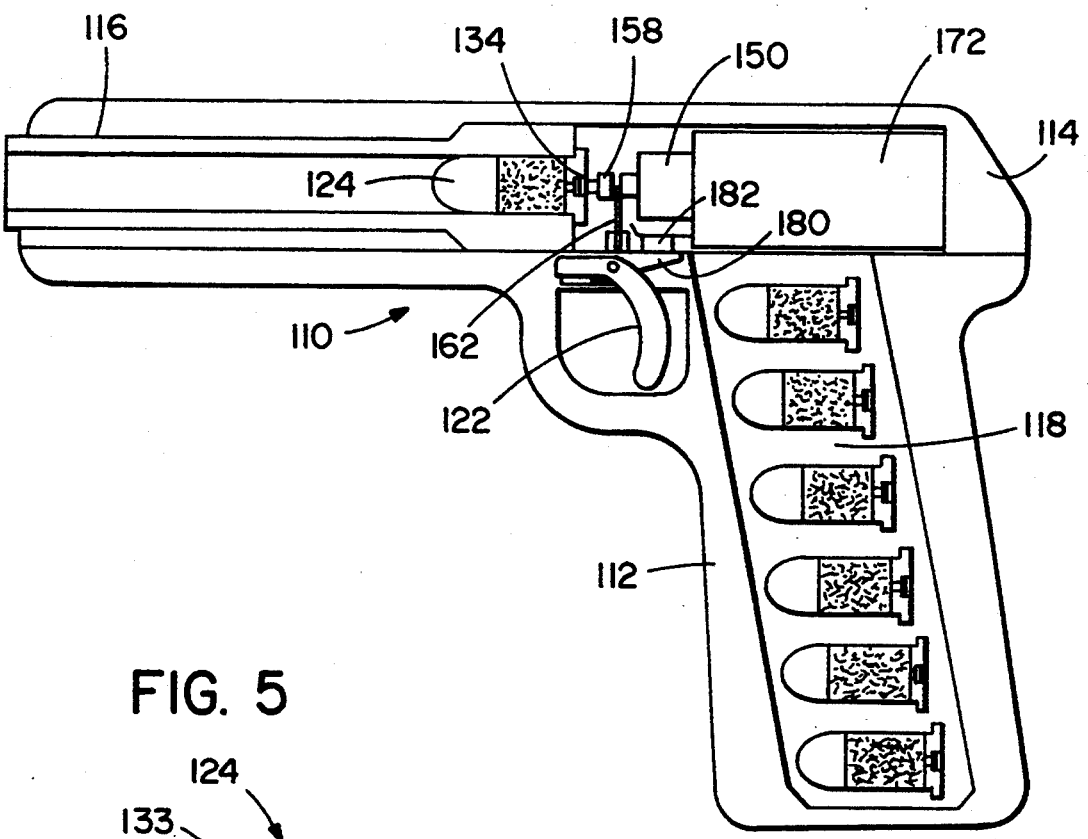
FIG. 4 is a schematic side view of a second pistol embodying the invention.

Referring now to FIG. 4, a second embodiment of a pistol 110 is illustrated. In the embodiment shown, the pistol 110 has a laser system 150 and battery 172 which are mounted in the slide 114 rather than in the handle of the pistol. The safety mechanism of pistol 110 includes a switch 180 and a magnet 182. As shown, the switch 180 is located at the top of the gun frame 112, and the magnet 182 is located at the bottom of slide 114. The magnet 182 will close switch 180, and permit the pistol 110 to fire, only when the magnet 182 is within a predetermined distance from the center of the switch 180. In a preferred embodiment, this predetermined distance is about b 0.10 inch. However, any suitable type of distance can be provided. Thus, if the slide 114 is not at its battery position, switch 180 will not be closed and the firearm 110 will not fire.

The pistol 110, similar to the pistol 10 shown in FIG. 1, includes frame 112, slide 114 movably mounted on the frame 112, a barrel 116 having a cartridge receiving chamber, and a cartridge magazine 118. The battery 172 is fixedly, but removably mounted to the slide 114. The laser 150 is also fixedly mounted to the slide 114. In an alternate embodiment, the laser 150 may be replaced by any suitable type of waveform energy source such as a flashlamp, a microwave generator, or an infra-red light generator. The output from the laser 150 is adapted to focus the energy at the propellant (primer or main propellant) located past the window 134. A gap is provided between the output end of the laser 150 and the lens 158 to allow the shutter 162 to move in.

Figure 5:
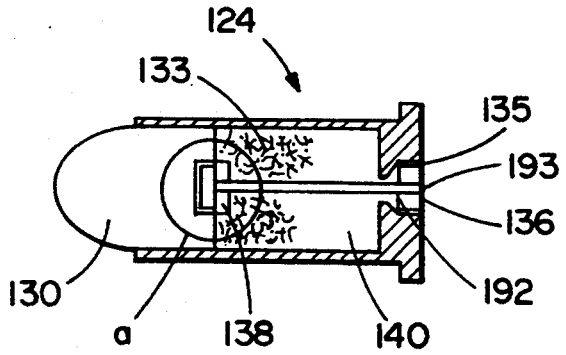
FIG. 5 is a sectional view of a cartridge used with the pistol of FIG. 4.
Figure 5A:
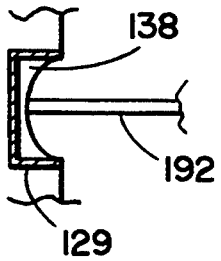
FIG. 5*a* is an enlarged view of area a as shown in FIG. 5.

The cartridge, generally designated 124, used with pistol 110 is illustrated most clearly in FIGS. 5 and 5*a*. As shown, the ignition composition or primer 138 is not in the cartridge base 136. Rather, the primer 138 is positioned forward of the cartridge base, so that at least some of the propellant 140 is between the point of the propellant ignition at primer 138 and the cartridge base 136. In the cartridge 124 of FIGS. 5 and 5*a*, a primer cap 129 containing the ignition composition 138 is press fitted into a recess in the base of projectile 130. A fiber optic element 192 extends coaxially from the outer end of cartridge base 136, through the cavity containing main propellant 140, to ignition composition/primer 138. Both ends of fiber optic element 192 are held in place by suitable means, such as epoxy. The rear end 193 of the fiber 192, which extends through the conventional primer cavity in base 136, is polished to facilitate light entry into the fiber 192. As will be apparent, both the safety mechanism of FIG. 4 and the forward ignition cartridge system of FIG. 5 can be used with a wide range of firearms.

Figure 6A:
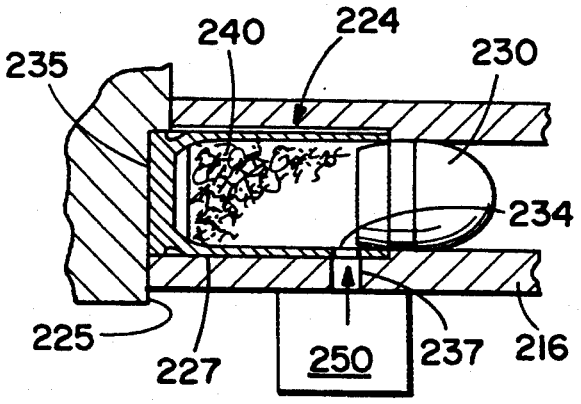
FIG. 6*a* is a schematic view of an alternate embodiment of the present invention.
Figure 6B:
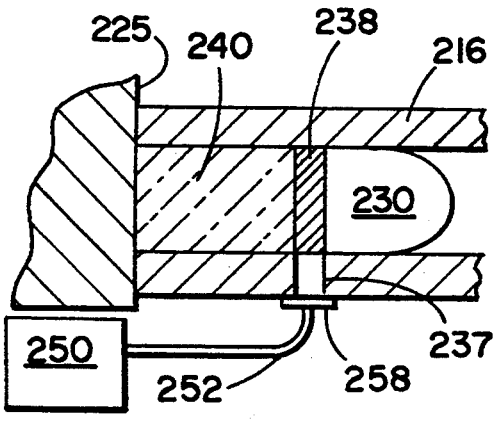
FIG. 6*b* is a schematic view of an alternate embodiment of the present invention.
Figure 6C:
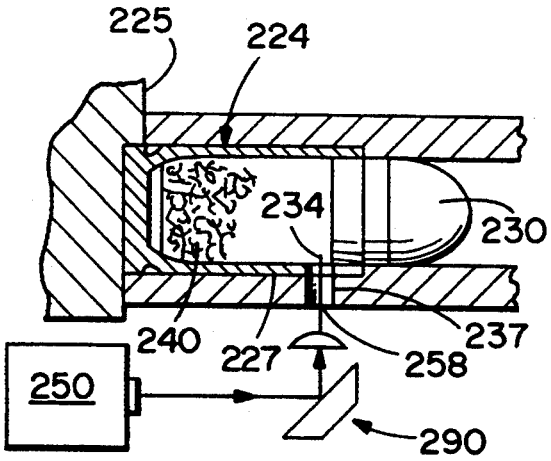
FIG. 6*c* is a schematic view of an alternate embodiment of the present invention.

Referring now to FIGS. 6*a*–6*c* alternate embodiments of firearms in which the laser system 250 is arranged to project light energy into a cartridge chamber through the side wall of the barrel, rather than through its breach end 225, are shown. FIGS. 6*a* and 6*c* illustrate a firearm system in which a cartridge, generally designated 224, is positioned in the chamber. FIG. 6*b* illustrates the use of caseless ammunition with the present invention. As used herein, "caseless ammunition" , is intended to mean a propellant and projectile that does not have a cartridge case or casing, such as casing 35 shown in FIG. 3.

In the embodiments shown, the primer/ignition composition 238 is provided in the form of a disc or ring located at the base or rear end of projectile 230. However, any suitably shaped primer/ignition composition may be provided. In addition, the primer/ignition composition 238 need not be located adjacent the rear end of projectile 230. The primer/ignition composition 238 could be located spaced from projectile 230 anywhere in the main propellant 240. In addition, the primer/ignition composition 238 could be spaced from casing 235 or adjacent thereto for cased ammunition or, spaced from or adjacent to the sides of the main propellant 240 for caseless ammunition. In regard to the cartridges shown in FIGS. 6*a* and 6*c*, an optically transparent window 234 is provided in the side wall of the casings 235. In the embodiments of FIGS. 6*a* and 6*c*, the cartridge case 235 is preferably brass and the window 234 is transparent epoxy, but the entire cartridge case 235 may be constructed of energy-transparent material. In each of the three embodiments of FIGS. 6*a*–6*c*, the laser or other energy passes to the cartridge chamber through an aperture 237 in the barrel 216. Particularly when so-called caseless ammunition is used, e.g., as in FIG. 6*b*, it is desirable to seal aperture 237, e.g., with a focusing lens 258 or window, as otherwise appropriate.

In FIG. 6*a*, the laser 250 is mounted below barrel 216, forward of the breech opening to the cartridge chamber 225 and located close to the barrel 216. Laser energy passes directly from the laser 250 to and through aperture 237. In FIGS. 6*b* and 6*c*, the laser 250 is spaced from the barrel 216, and the laser energy is transmitted from the laser 250 to aperture 237 either through optical fibers 252 or through a focusing reflector 290. In FIG. 6*b*, a focusing lens 258 is provided in the aperture; in FIG. 6*c*, a focusing lens is part of focusing reflector 290, and aperture 237 is epoxy filled.

Figure 7:
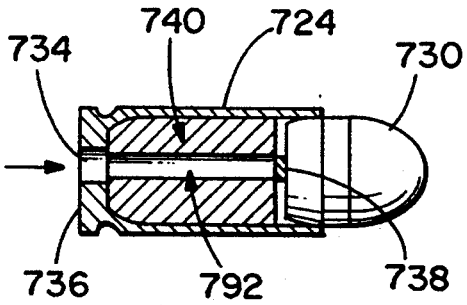
FIG. 7 is a schematic sectional view of an alternate embodiment of a cartridge for use with the present invention.

FIG. 7 illustrates another embodiment of a cartridge 724 in which the primer 738 is located forward of the cartridge base 736. In cartridge 724, the primer 738 is at the base or rear end of the projectile 730. A transparent window 734 is provided in the center of the cartridge base 736. The propellant 740 is solid (e.g., cast or molded) rather than loose powder, and a hollow passage 792 extends between the primer 738 and window 734.

Figure 8:
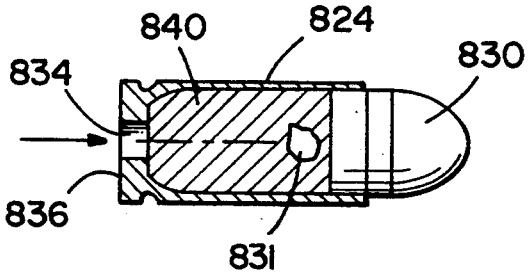
FIG. 8 is a schematic sectional view of an alternate embodiment of a cartridge for use with the present invention.

Cartridge 824, shown in FIG. 8, contains neither a separate primer nor a coaxial light-conductor. Rather, the laser energy passes through window 834, focuses on the base 831 of projectile 830; and directly ignites the propellant 840.

It will be noted that, in cartridges 124 (FIG. 5) and 624 (FIG. 6) primer or other ignition composition is positioned at the base of the projectile. As previously indicated, the benefits of "forward ignition" may also be obtained in systems in which the primer is in other positions between the projectile and cartridge base, a point of initiation forward of at least some of the main propellant. Similarly, the side-ignition system of FIGS. 6a–6c may be used in both cartridge and caseless systems in which the primer is at any desired location between the projectile base and the rear end of the propellant.

Figure 9:
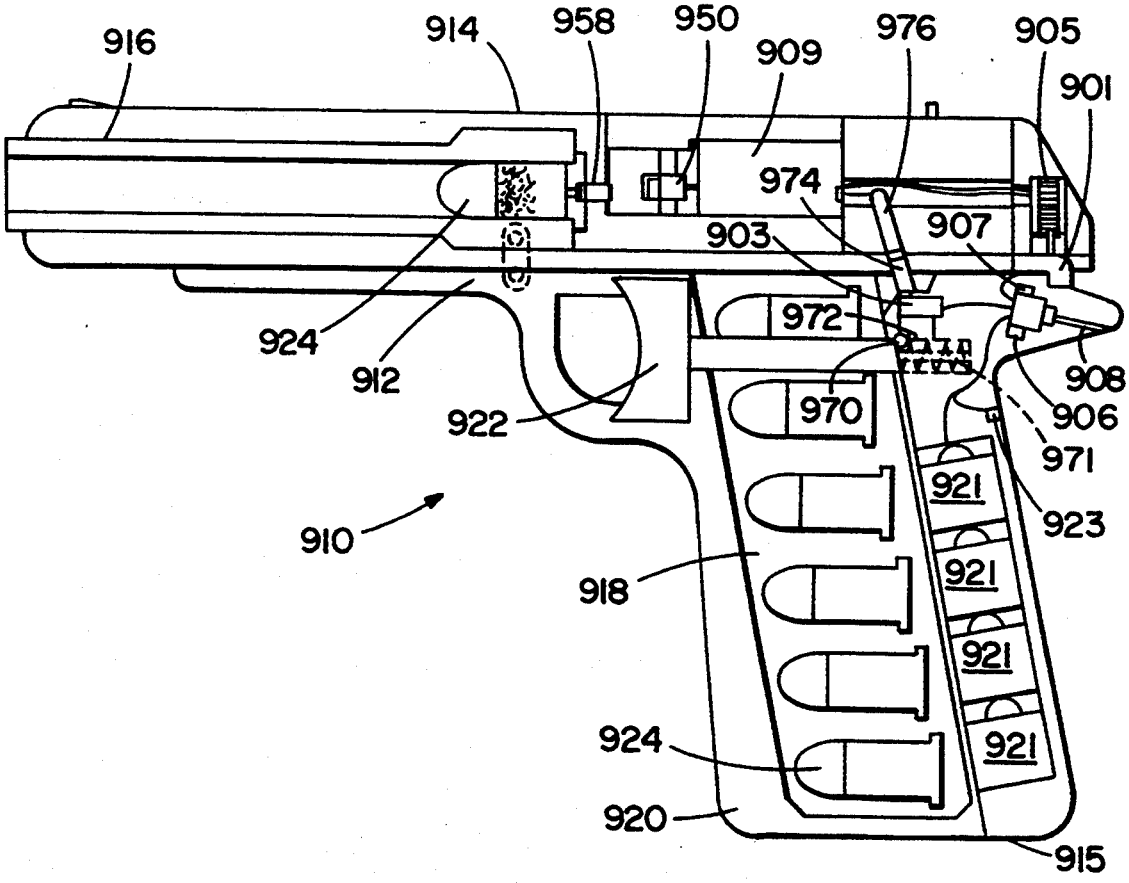
FIG. 9 is a side schematic view, partially cut-away, of another handgun embodying the invention.

Referring now to FIGS. 9 and 10a–10c, a schematic view of pistol 910 and schematic diagrams of electronic circuits for use in the pistol 910 of FIG. 9 are shown. The pistol 910 generally comprises a frame 912, a slide 914, a barrel 916, a trigger 922, and a cartridge magazine 918 removably connected to the grip 920 of the frame. The firing assembly generally comprises a laser 950. Power for the pistol 910 is provided by four NiCad batteries 921, each producing about 1.35 volts and connected in series, mounted in the grip 920. An electrical jack 923 is provided to enable recharge of batteries 921 using an external direct current charging circuit, typically limiting current to about 7 milliampers over a 10 hour minimum charge cycle. The cartridges, generally designated 924, are substantially as previously described with reference to cartridge 124 of FIG. 5.

The electronics of pistol 910, the circuitry for which is most clearly shown in FIGS. 10a–10c, are grounded to the frame 912 and slide 914 by a brass grounding contact 915 which is, in turn, connected to the negative polarity side of the serially-connected batteries 921. A toggle switch 908 mounted in the upper portion of handle 920 is connected to the positive polarity side or terminal of the batteries 921 and is adapted to make or break the electrical connection or circuit from the batteries 921 to the various electrical components.

A voltage sensor electronic circuit, generally designated 907, shown schematically in FIG. 10a and mounted in handle 920, monitors the voltage of the serially connected batteries 921 and, if the total voltage exceeds a predetermined amount, such as 4.8 , volts, illuminates a green color light emitting diode (LED) 906 to signal the user that the battery power is sufficient to initiate firing. As is evident, circuit 907 is actuated whenever switch 908 is in its "ON" position.

When switch 908 is in its "ON" position, it also permits current to flow directly to the trigger electronics 903 in the grip 920. A schematic diagram of the trigger electronics 903 is shown in FIG. 10b. Current also flows through brass contact 901 and spring loaded slider contact 905 to the laser pulse forming electronics 909 in slide 914. A schematic diagram of the laser pulse forming electronics is shown in FIG. 10c. The power input to the circuits shown in FIGS. 10b and 10c is controlled by switch 908. As indicated schematically in FIGS. 10a–10c, both the trigger electronics 903 and the laser pulse forming electronics 909 are connected to the output of Switch 908 in circuit 907 at connection point A.

The trigger electronics 903, in the embodiment shown, is actuated by a magnet 970 which is attached to trigger 922 positioned such that, when the trigger is squeezed to effect firing, it will activate a Hall effect device 972 in the trigger electronics circuit 903. However, any suitable means to activate the trigger electronics 903 may be provided. The trigger action is established by a dual constant spring 971, and may be easily adjusted to the user's desired trigger pull. For the embodiment shown, upon activation of the Hall effect device 972, the trigger electronics circuit 903 sends a short duration pulse, such as 2 to 5 ms, to infrared light emitting diode 974, causing the LED 974 to emit an IR light pulse. The IR pulse from LED 974 is received by an infrared phototransistor 976 in the laser pulse forming electronics circuit 909. The phototransistor 976, upon being activated by receipt of the IR pulse from LED 974, activates the laser pulse forming electronics 909. The activation of circuit 909 causes a nominal electrical pulse, such as a 2 amp pulse for 10 ms, to flow to laser diode 950. This, in turn, causes the diode 950 to emit the energy pulse at the cartridge 924 required to fire the handgun. As in the previously discussed embodiments, the infrared laser output from the laser diode 950 is focused by GRIN lens 958 and initiates the propellant in chambered cartridge 924.

It will be apparent that the present invention is not restricted to systems in which laser energy is used to initiate a primer. Rather, systems according to the present invention may initiate a propellant using other high frequency energy, such as microwave or ultrasonic. Such energy may be transmitted from a distant energy source through any suitable wave guide, such as a stripline, or a microwave or sound wave guide, depending largely on the nature of the propellant. Initiation may be accomplished either directly to a main propellant, or with an ignition composition other than a conventional primer.

It should also be apparent that the present invention is not restricted to small arms which employ cartridges, but rather may be employed in any firearm including handguns, rifles, shotguns, cannon, etc., using either cartridges or caseless ammunition.

In this respect, it will be noted that most weapons are designed to be fired only when in a battery position, and that according to the present invention may include means for insuring that the laser beam or other energy will not initiate the pyrotechnic charge when the action is not ready to fire. For example, a revolver is in a battery position when the cylinder is locked in position with a chamber and cartridge in line with the barrel; and in a revolver the energy path from the energy source to the chamber may pass through the cylinder so that it will be interrupted unless the cylinder is in the firing position. Similarly, a rifle is in its battery position when its bolt is closed; and the energy path may pass through the bolt and surrounding positions thereof such that the path will be interrupted unless the bolt is closed. In a shotgun, which is in a battery position when its action is closed, and the desired battery only firing operation may be provided by arranging the energy path such that it will be interrupted by any misalignment of the action or bolt relative to its closed position. In each of these examples, the action of the firearm includes at least two relatively moveable parts, the energy path passes through both, and the path portions in the two parts are in alignment (i.e., the path is complete and uninterrupted) only when the two parts are in a predetermined firing position.

In lieu of, or in addition to, the safety systems described above, a firearm according to the present invention may include a wide range of other safety mechanisms which block or control the direction of the energy path. One such mechanism has previously been described with reference to FIGS. 1–3. Others include, for example, a safety lever for rotating the focuser reflector 290 in the embodiment of FIG. 6c, or, in any of the disclosed embodiments, providing an electrically operated LCD shutter in the optical energy path.

The present invention provides a high frequency (e.g., laser) pyrotechnic initiation system that has all of the reliability of conventional mechanical percussion primer system, but that also provides significant benefits when compared to conventional systems. In particular the system of the present invention provides significantly improved accuracy and interior ballistics while at the same time reducing the propellant charge and felt recoil associated with a desired projectile velocity. Firearms according to the present invention also have reduced locktime, barrel wear and muzzle flash, minimize or eliminate costs and variability inevitable with mechanical constructions, and make possible dramatically improved safety features.

In one aspect, the present invention features such a system in which two relatively movable parts of the action of a weapon provide a path that permits the energy required for propellant initiation to pass from the energy source to the propellant only when the action is in battery. In a second aspect, a wave guide, e.g., optical light-conducting fibers, extends from the source of high frequency energy to adjacent the chamber containing the propellant so that energy passed through the wave guide will pass into the chamber and ignite the propellant therein. A third aspect features a firearm cartridge propellant/projectile assembly (e.g., a cartridge in which the point of ignition (e.g., the primer) is positioned forward of at least part of the propellant and which is constructed so that high frequency (e.g., laser, ultrasonic, microwave) energy will initiate ignition at the forward position. Preferred aspects include side ignition of the ignition composition and further safety assemblies for interrupting the high frequency energy path and thus preventing unwanted explosive ignition.

Referring now to FIG. 11, a schematic view of an alternate embodiment of the present invention is shown. The pistol 1110 is substantially similar to the pistol 110 shown in FIG. 4. The pistol 1110 has a frame 1112, a barrel 1116, a slide 1114, and an energy source 1150. The frame 1112 has a cartridge magazine receiving area 1117 in its handle 1120 for removably receiving a cartridge magazine 1118. The cartridge magazine 1118 has a housing 1119 with a movable follower and spring, as is known in the art, adapted to housing and dispense cartridges 124. In the embodiment shown, the cartridge magazine 1118 also comprises a battery 1151 fixedly connected to the magazine housing 1119. The battery 1151 is removably mounted to the magazine housing 1119, but may be permanently fixed to the housing 1119. The magazine 1118 also comprises electrical contacts 1121 at its top and conductors 1123 that extend between the terminals of the battery 1151 and the contacts 1121. The energy source 1150 also comprises contacts 1153 at the receiving area 1117 adapted to make electrical contact with the contacts 1121. In alternate embodiments, the battery 1151 may have terminals that are directly connectable to the contacts 1153 of the energy source or, the frame 1112 may have suitable contacts and conductors to connect the electrical contacts of the magazine to the energy source 1150.

In the embodiment shown, the battery 1151 of the magazine 1118 constitutes the only power source for the energy source 1150. Because the magazine 1118 is removably mounted to the frame 1112, when the magazine is not fully inserted in the receiving area 1117, the energy source 1150 is not connected to a power source. Therefore, the pistol 1110 is unable to fire. Only when the magazine 1118 is properly connected in area 1117 is the pistol 1110 able to fire. Therefore, this type of combined cartridge magazine and power supply adds an extra safety mechanism to the pistol 1110. The pistol 1110 and/or magazine 1118 can also comprise an LED and electrical circuitry, such as disclosed in the other embodiments discussed above, to signal a predetermined condition of the battery's power, such as too weak to allow proper discharge of the firearm. However, any suitable type of combined cartridge magazine and power supply could be provided. Although the power supply has been described as battery 1151, any suitable type of power supply could be used including solar power cells, etc. In addition, the battery 1151 could be used to power other features or functions, such as a laser sight and, therefore, the magazine 1118 could also be used in firearms that do not have waveform energy ignition systems, but may be used with conventional mechanical firing systems. In the embodiment shown, the battery is located parallel to the cartridge receiving area of the housing 1119 and, therefore, does not interfere with the movement of the cartridges, follower, or spring in the cartridge receiving area. In an alternate embodiment, the battery 1151 may be located below the cartridge receiving area or at any suitable location or locations of the magazine housing 1119.

Figure 12:
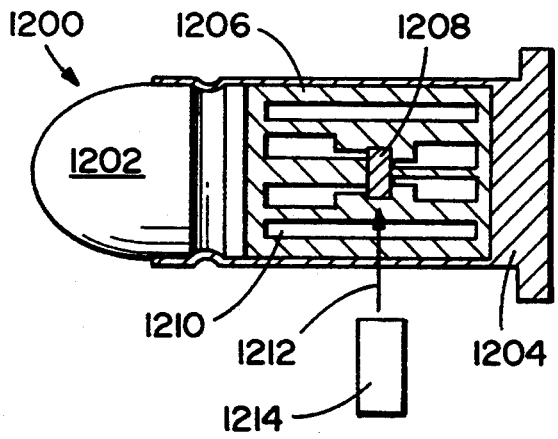
FIG. 12 is a schematic sectional view of an alternate embodiment of a cartridge for use with the present invention.

Referring now to FIG. 12, a schematic view of a cartridge 1200 is shown. In the embodiment shown, the cartridge 1200 generally comprises a projectile 1202, a casing 1204, a propellant charge 1206, an initiation charge 1208, and spaces or control surface regions 1210. In the embodiment shown the propellant charge 1206 surrounds the initiation charge 1208. This type of structure can be provided by any suitable means including providing the propellant charge 1206 as two unitary members that sandwich the initiation charge 1208 therebetween when assembled in the casing 1204 or, molding the propellant charge 1206 around the initiation charge 1208. In the embodiment shown, the propellant charge is provided as a unary or unitary member that is inserted in the casing 1204 in the form of a pellet. During forming of the pellet, spaces 1210 are formed therein. As can be seen, some of these spaces 1210 are connected to and about the initiation charge 1208.

With this type of cartridge, output 1212 from an energy source 1214, such as a laser, can be focused at the initiation charge 1208. When the initiation charge 1208 ignites, it spreads into spaces 1210 relatively quickly. This produces ignition of the propellant charge 1206 along a relatively large area of the spaces 1210. Thus, the volume of propellant charge 1206 burns faster and at a predetermined controlled rate based upon the specific pattern of spaces 1210. The spaces 1210 can be suitably sized, shaped and configured to provide predetermined ballistics tailored to yield desired weapon characteristics by providing predetermined patterns of burns of the propellant charge 1206.

Figure 13:
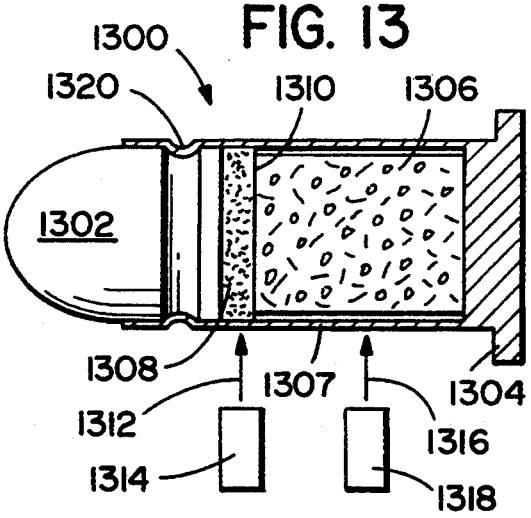
FIG. 13 is a schematic sectional view of an alternate embodiment of a cartridge for use with the present invention.

Referring now to FIG. 13, a schematic view of an alternate embodiment of a cartridge 1300 is shown. In the embodiment shown, the cartridge 1300 generally comprises a projectile 1302, a casing 1304, a main propellant charge 1306, a pre-pressurizing charge 1308, and a barrier 1310. This type of cartridge is generally designed such that the main charge 1306 is pre-pressurized by gases from the pre-pressurizing charge 1308 prior to ignition of the main charge 1306. The main charge 1306 is not initiated until the pre-pressurizing charge 1308 has increased pressure against the main charge 1306 to a predetermined level such that the main charge 1306 can then be initiated to thereby burn at a predetermined rate. For the cartridge 1300 shown in FIG. 13, output 1312 from a first laser 1314 is focused at the pre-pressurizing charge 1308 to ignite the charge. In a preferred embodiment, the charge 1308 is designed to rapidly generate pressure inside the casing 1304 of about several hundred to over one thousand pounds per square inch (psi). Any suitable material can be used as the pre-pressurizing charge 1308, but in a preferred embodiment boron potassium nitrate is used with burning rate additives. After initiation of the pre-pressurizing charge 1308, output 1316 from laser 1318 ignites the initiation charge 1307 which, in turn, ignites the main charge 1306. Materials that are used for main propellant charges, such as smokeless powder, burn at rates highly dependent upon surrounding pressure. By initiating burn of the main charge 1306 at a substantially high pressure, the main propellant charge 1306 will burn faster. The crimp 1320 of the casing 1304 to the projectile 1302 is designed maintain cartridge integrity through the pre-pressurization phase.

In conventional ammunition the primer produces hot sparks which are primary in producing ignition of the main propellant and pressure which sets the initial burning character for the propellant bed. Variability in initial pressurization is directly responsible for variable interior ballistics and consequent weapon inaccuracies. Use of heavier primers has been shown to improve aiming but no one has determined whether it is the additional burning surface caused by more hot particles or the additional pressure generated by the more energetic primer which results in improved characteristics. In any case the cause of improvement by use of the configuration shown in FIG. 13 is related to higher pressures earlier in the cycle which should improve ballistics. By starting the main propellant charge burn at a high rate, more of the propellant will burn before the projectile leaves the muzzle of the firearm and, the pressure-time curves inside the gun should be more reproducible. In the embodiment shown in FIG. 13, the barrier 1310 prevents the pre-pressurizing charge 1308 from prematurely igniting the main charge 1306. However, in alternate embodiments, any suitable positioning of the charges 1306, 1307, 1308 could be provided and, only one laser need be provided. Although the cartridge ].300 shown in FIG. 13 has barrier 1310 located between the two charges 1306 and 1308, it should be understood that any suitable means could be provided to prevent, or at least delay, the pre-pressurizing charge 1308 from igniting the main charge 1306. One such means to prevent premature ignition of the main charge before a desired pressure is obtained may merely comprise the selection of appropriate materials for the charges 1306 and 1308, without any barrier between the two charges, such that the pre-pressurizing charge can burn and exert pressure on the main propellant charge without igniting the main propellant charge. Another configuration could comprise the main propellant charge have multiple layers of different types of propellant with a first type of propellant having a relatively high ignition temperature being located adjacent the pre-pressurizing charge and, a second type of propellant having a relatively lower ignition temperature being located spaced from the pre-pressurizing charge by the first type of propellant.

Figure 14:
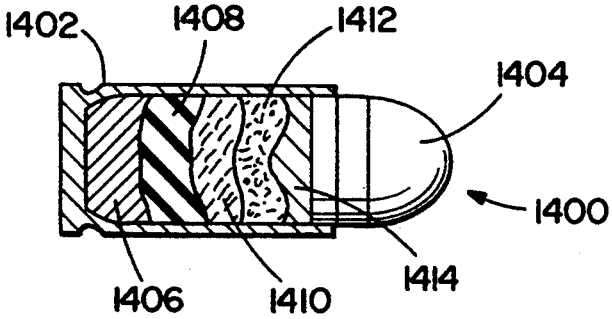
FIG. 14 is a schematic sectional view of an alternate embodiment of a cartridge for use with the present invention.

Referring now to FIG. 14, a schematic view of an alternate embodiment of a cartridge 1400 is shown. In the embodiment shown, the cartridge 1400 generally comprises a casing 1402, a projectile 1404, and five layers 1406, 1408, 1410, 1412, 1414 of propellant. Although five layers of propellant are shown, it should be understood that any suitable number of layers could be provided. The layers of propellant, in the embodiment shown, are shaped to enable tailoring and controlling of the burn rates. This can be used to reduce the peak chamber pressures to reduce stress on the firearm components and increase projectile velocity or, maintain projectile velocity with a reduced volume of propellant than in conventional cartridges. The propellant layers or segments can be provided by any suitable form of casting, extrusion or solidifying process, etc. The layers 1406–1414 are preferably made of different types of propellants and, initiation is commenced at the layer 1414 closest to the projectile 1404. However, any suitable sizes, shapes or types of layers could be provided.

For a multi-layered propellant cartridge, such as cartridge 1400, multiple strikes or beams of waveform energy can be directed to individual layers, sequentially and/or concurrently, to produce a desired pattern and/or timing of burn of the propellants. Multiple strikes can also be used on single layers of a multi-layered propellant charge or a single propellant charge in order to produce a desired pattern of burn. Obviously any suitable type of propellant configuration and multiple strikes can be provided in order to produce any suitable type of propellant burn pattern. This can significantly increase control of burn rates and resulting chamber pressures that was heretofore unavailable. This type of method of control can also be used with a primer and propellant with at least one beam of energy delivered to the primer before, during, or after delivery of a beam to the propellant. One of the advantages of the present invention over the prior art is that virtually all of the propellant can be burned before the projectile exits the firearm. This can eliminate muzzle flash and add safety by virtually eliminating residual unburnt propellant.

Figure 15:
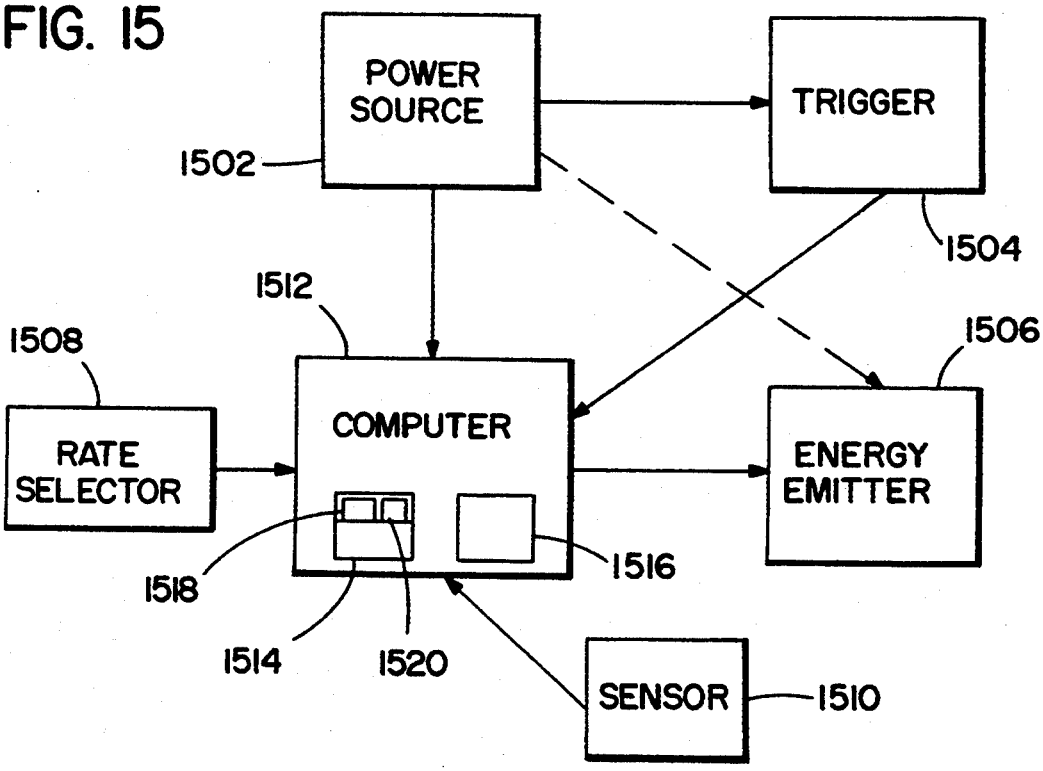
FIG. 15 is a schematic block diagram of an ignition system for a firearm.

Referring now to FIG. 15, there is shown a schematic block diagram of an alternative embodiment of an ignition system for a firearm. The ignition system generally comprises a power source 1502, a trigger 1504, an energy emitter 1506, a rate selector 1508, a sensor 1510, and a computer 1512. The power source 1502 can be any suitable electrical power source and is connected to the trigger 1504 and the computer 1512. The trigger 1504 can be any suitable type of trigger adapted to signal actuation by a user to the computer. The energy emitter 1506 can be any suitable type of energy source such as a laser, etc. Discharge of the emitter 1506 is controlled by the computer 1512. The computer 1512 can be any suitable type of computer. In the embodiment shown, the computer 1512 generally comprises a microprocessor 1515 and a memory 1516. The memory 1516 can include a Read Only Memory (ROM) and/or a Random Access Memory (RAM) and/or DRAM, etc. The computer 1512 is generally adapted to control discharge of the energy emitter 1506 to ignite a propellant in a firearm. In the embodiment shown, connected to the computer 1512 is a sensor 1510 and a rate selector 1508. However, it should be understood that the present invention can be embodied without a sensor or rate selector connected to the computer. The sensor 1510 may also comprise a plurality of sensors. The sensor 1510 is generally adapted to sense a predetermined characteristic or feature of the firearm such as a bolt being located at a battery position. The sensor 1510 can signal the computer 1512 of the state of the predetermined characteristic or condition. The rate selector 1508 is a manually operable switch adapted to signal the computer 1512 of its setting. In a preferred embodiment, the rate selector is adapted to signal four possible setting; "SAFE", "SINGLE FIRE", "BURST FIRE", and "AUTOMATIC". However, any suitable type of selectable setting could be provided. The computer 1512 will control discharge of the energy emitter 1506 based upon the setting of the rate selector. In the SAFE setting, the computer 1512 will prevent the energy emitter 1506 from discharging energy. In the SINGLE FIRE setting, the computer 1512 will allow only semi-automatic firing of the firearm; i.e.: the firearm will fire only one projectile each time the trigger 1504 is actuated. In the BURST FIRE setting, the computer 1512 will allow limited bursts of automatic firing each time the trigger 1504 is actuated. The number of times a projectile is fired from the firearm for each burst can be programmed in the memory 1516, such as two, three, four, etc. In the AUTOMATIC setting, the computer 1512 allows full automatic firing while the trigger is actuated. For the SINGLE FIRE and BURST FIRE operations, the sensor 1510 can be used to sense discharges of the firearm, such as by monitoring movement of a bolt relative to its battery position. The memory 1516 may also be a programmable memory such that the firearm can be configured to provide predetermined user selected firing characteristics. The rate selector 1508 could alternatively or additionally be used to selectively change the rate of fire of the firearm, such as varying the rate of fire, such as 100 rounds per minute, 300 rounds per minute, 500 rounds per minute, etc. In a preferred embodiment, the computer 1512 includes a clock 1518 and a counter 1520. However, the clock or timer 1518 and counter 1520 need not be provided. In the embodiment shown, the clock 1518 and counter 1520 are integrally formed with the microprocessor 1514, but may be provided separately. Any suitable type of selectable options can be provided. It should also be understood that the present invention need not be used merely with an energy emitter, but may also be used with a conventional firing pin or striker type system for burst control, firing rate control, or safety selection, such as when the firearm is provided with a suitable electro-mechanically operated disconnector.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm cartridge comprising:

a casing;

a projectile connected to the casing;

a pre-pressurizing charge located inside the casing behind a rear end of the projectile;

a main propellant charge located inside the casing behind the rear end of the projectile; and a barrier located between the pre-pressurizing charge and the main propellant charge, the barrier being adapted to substantially prevent the pre-pressurizing charge from igniting the main propellant charge, but allow pressure from burning of the pre-pressurizing charge to the exerted on the main propellant charge wherein the pre-pressurizing charge is located adjacent the rear end of the projectile.

2. A cartridge as in claim 1 wherein the casing has means to allow separate ignition of the two charges.

3. A firearm cartridge comprising:

a casing;

projectile connected to the casing;

a pre-pressurizing charge located inside the casing and located adjacent a rear end of the projectile; and a main propellant charge located inside the case, wherein the pre-pressurizing charge and main propellant charge comprise suitable materials such that the pre-pressurizing charge can burn and exert pressure on the main propellant charge without igniting the main propellant charge and, the connection of the projectile to the casing prevents the projectile from being disconnected from the casing until the main propellant charge is ignited.

* * * * *